United States Patent [19]

Adams

[11] Patent Number: 4,949,552

[45] Date of Patent: Aug. 21, 1990

[54] COOLING SYSTEM FOR REMOTELY DISPENSED BEVERAGES

[75] Inventor: Rodney W. Adams, Beach Park, Ill.

[73] Assignee: Perfection Equipment, Inc., Gurnee, Ill.

[21] Appl. No.: 254,704

[22] Filed: Oct. 7, 1988

[51] Int. Cl.[5] ..... F25B 41/04

[52] U.S. Cl. ..... 62/196.4; 62/393; 62/399

[58] Field of Search ..... 62/196.4, 393, 399, 62/439, 434, 435, 216, 224; 222/146.6

[56] References Cited

U.S. PATENT DOCUMENTS

| | | | |
|---|---|---|---|
| 3,443,394 | 5/1969 | Knonick | 62/393 X |
| 3,481,151 | 12/1969 | Seeley | 62/196.4 |
| 3,555,843 | 1/1971 | Cook | 62/196.4 |
| 4,242,881 | 1/1981 | Williams | 62/399 X |
| 4,676,400 | 6/1987 | Lamont et al. | 62/393 X |

FOREIGN PATENT DOCUMENTS

| | | | |
|---|---|---|---|
| 0119151 | 9/1979 | Japan | 62/196.4 |

*Primary Examiner*—Harry B. Tanner

*Attorney, Agent, or Firm*—Dressler, Goldsmith, Shore, Sutker & Milnamow, Ltd.

[57] ABSTRACT

A refrigeration unit and a glycol unit are integrated to provide a cooling system for beer being delivered through a line run to dispensing stations remote from the beer storage cooler. A chiller coil of the glycol unit is coaxial within the evaporator coil of the refrigeration unit where the glycol coolant is chilled and then flows directly into the line run. Constant temperature of the coolant in the chiller coil is maintained by the maintenance of a constant pre-set vapor pressure of the refrigerant gas in the evaporator coil. The pre-set vapor pressure is maintained by a hot gas bypass valve which automatically meters hot refrigerant gas from the output of the compressor directly to the evaporator coil when the vapor pressure falls below the pre-set pressure. The compressor operates continuously and only a relatively small volume of the glycol coolant is stored in the tank of the glycol unit.

11 Claims, 1 Drawing Sheet

COOLING SYSTEM FOR REMOTELY DISPENSED BEVERAGES

TECHNICAL FIELD

This invention relates to refrigeration and liquid temperature control systems and, more particularly, to a system for accurately maintaining the temperature of a beverage such as beer required to be dispensed at one or more stations remote from the source of the beverage supply.

BACKGROUND OF THE INVENTION

Certain beverages are highly sensitive to temperature which can affect their appeal, both in taste and appearance. Beer, for example, is most flavorful and visually appealing when drunk in a narrow temperature range of from about 34° to 38° F. When beer is dispensed or poured directly from a refrigerated container, maintenance of the ideal drinking temperature presents no real problems.

Frequently, however, beer is stored in a large refrigerated cabinet or walk-in cooler and dispensed on tap at stations remote from the storage area. For example, in large meeting rooms, banquet halls, restaurants, or bars, the beer dispensing stations may be anywhere from 10 feet to 600 feet from the refrigerated storage area. Generally, the beer is delivered through suitable plastic or stainless tubing and the temperature control of the beer while traveling over such long distances requires relatively complex and expensive cooling systems. In effect, such temperature control systems comprise the combination of a basic refrigeration unit with a cooling medium for the delivery tubing.

The basic refrigeration unit comprises a closed system containing a low boiling refrigerant like freon, a compressor, a condenser coil, and an evaporator or chilling coil. Also included in the basic refrigeration unit is some type of electrical thermostatic control device for switching the compressor on and off as required to maintain the pre-set desired temperature.

The function of the cooling unit is to maintain the beer temperature in the delivery system connecting the beer storage and dispensing points. Typically, the delivery system, or line run, consists of beer tubing surrounded by or in contact with another tube adapted to carry a circulating coolant fluid which has been refrigerated to the desired temperature by the refrigeration unit. A variety of coolant fluids may be employed, but the one most commonly used in beer delivery systems of the type under consideration is a glycol-water mixture, and the cooling units using this liquid are commonly known as glycol units.

Conventional glycol units consist of an insulated container holding a relatively large volume, or bath, of the glycol-water mixture, on the order of 5 to 50 gallons. Coils of the refrigeration unit evaporator are positioned within the container and serve to chill the coolant liquid until it reaches the pre-set point of the temperature-sensitive thermostat whose sensing element is likewise immersed in the bath. The chilled coolant is then pumped from the container into the line run and back again. Despite its widespread usage, the described refrigeration unit-glycol unit cooling system was characterized by a number of disadvantageous features.

With control governed by thermostat, the coolant temperature could vary from the "on" set point of the thermostat to its "off" set point, a typical differential of from 3° to 5° F. Agitators were sometimes required to overcome the tendency for temperature stratification in the large volumes of coolant liquid. The sensitive thermostat and its associated electrical elements were subject to wear and breakdown necessitating replacement of those expensive parts.

Unnecessarily high operating expense was another undesirable attribute of the prior refrigeration-glycol systems. If a leak occurred in the coolant line, the cost of replacing the large volumes of glycol was high. When operating, the compressor was always running at full rated capacity, and the intermittent on-off cycles also caused electrical power surges for each start-up. Additionally, the warmed coolant was returned from the line run back into the bath which served as a temperature reservoir so that it was necessary to continually chill the large volume of coolant. The bath cooling also served as a limitation on the length of line run which could be employed because too great a length would cause excessive temperature rise of the coolant, thereby necessitating a much lower bath temperature in order to maintain the desired drinking temperature at the end dispensing station.

There thus exists a need for an improved refrigeration-glycol cooling system for remotely dispensed beverage applications.

SUMMARY OF THE INVENTION

The present invention provides a cooling system for remotely dispensed beverages which substantially eliminates or greatly reduces the problems inherent in the prior systems. The inventive system is simplified in structure and operation, less expensive to operate and maintain, and yet is most efficient for the purposes intended.

In the present invention, there is no glycol coolant bath, nor any electrical thermostat for sensing the temperature of such a bath. The glycol unit of the invention comprises an insulated container holding a small amount of coolant liquid on the order of one gallon, or less. The container acts solely as a holding tank for the coolant liquid, and no refrigeration takes place in the tank. An associated pump draws the liquid from the tank and injects it into the inner tube of a coaxial chilling coil, the outer tube of said chilling coil comprising the evaporator coil of the refrigeration unit. Upon leaving the chilling coil, the coolant liquid goes directly into the line run and then is returned to the tank.

Constant temperature of the chilled coolant is regulated by the refrigeration unit without the use of conventional electrical thermostats, or the like. The compressor of the refrigeration unit operates continuously to draw refrigerant vapor, preferably freon, from the evaporator. Vaporization rate of the refrigerant is directly proportional to the temperature of coolant being chilled, so that the vapor pressure in the evaporator continues to drop until the coolant reaches the desired pre-set temperature.

A pair of expansion valves is incorporated in the refrigeration unit. One valve functions to maintain the evaporator flooded with refrigerant liquid from the unit's compressor. The second valve functions as a hot gas bypass from the compressor directly into the evaporator. Operating according to basic physical laws of gases, the two valves function to maintain a constant pressure, and thereby a constant temperature in the evaporator. This results not only in the maintenance of the pre-set temperature, but also in an efficient operating rate of the compressor which is only sufficient to balance the cooling load requirements of the entire beer delivery system.

Numerous other advantages and features of the present invention will become apparent from the following detailed description of the invention, from the claims, and from the accompanying drawings.

DETAILED DESCRIPTION OF THE INVENTION

Figure 1:
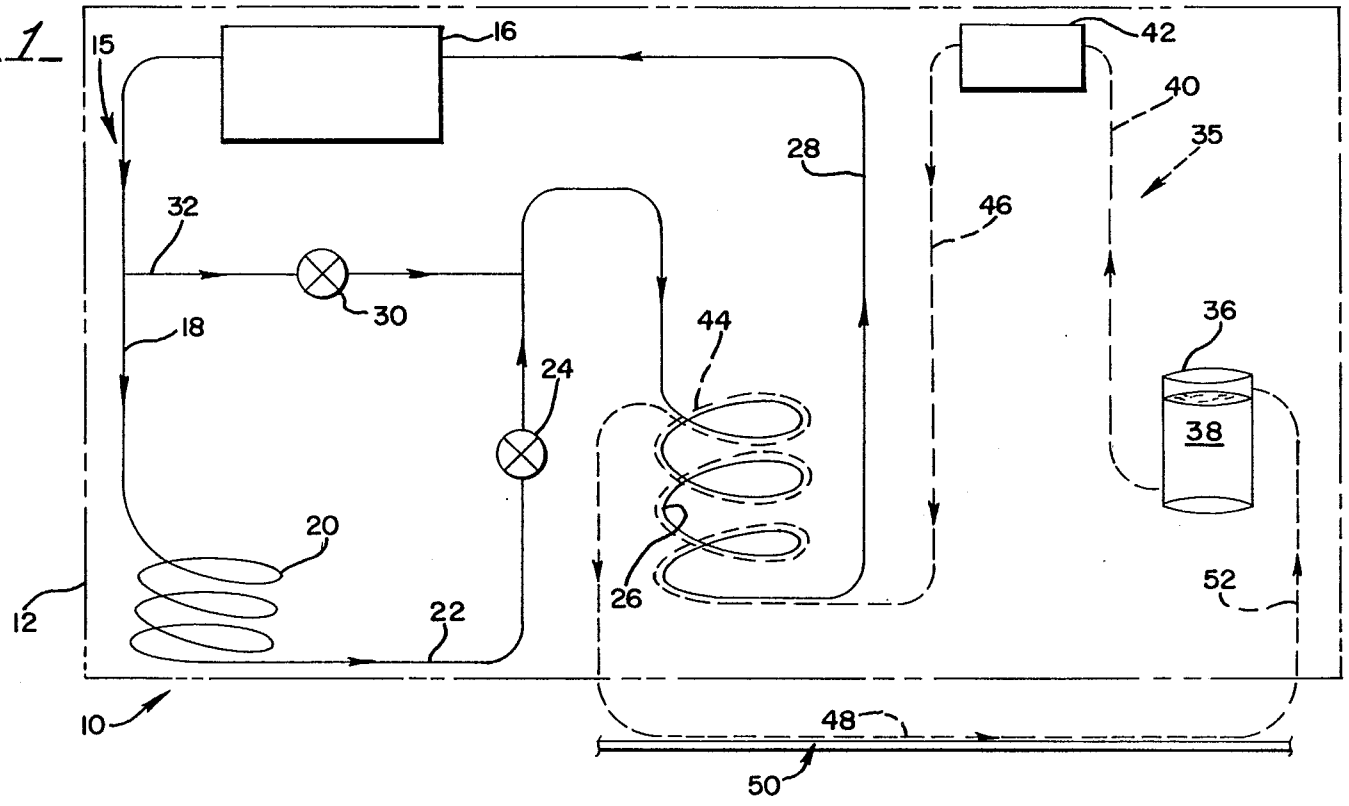
FIG. 1 is a schematic circuit diagram of a cooling system for remotely dispensed beverages embodying the principles of the invention.

Referring with greater particularity to FIG. 1, the reference numeral 10 identifies generally a cooling system embodying the principles of the invention. The cooling system 10 preferably is a self-contained unit which may be mounted in a suitable housing or cabinet 12, shown in broken line. System 10 comprises a refrigeration unit 15 and a glycol unit 35 integrated in the manner to be described.

Refrigeration unit 15 comprises a compressor 16 communicating through line 18 with a condenser coil 20. Condenser 20 communicates through line 22 with a thermal expansion valve 24 and an evaporator coil 26. Evaporator coil 26 returns to the compressor 16 through line 28 to complete a conventional refrigeration circuit. Thermal expansion valve 24 is externally equalized and controls the flow of liquid refrigerant, preferably freon, to maintain the evaporator coil flooded with said refrigerant.

Refrigeration unit 15 comprises further an automatic expansion valve 30 connected by a shunt or bypass line 32 between the compressor 16 and evaporator coil 26. The automatic expansion valve 30 is externally equalized and functions to bypass the condenser coil 20 and pass hot gases from the compressor directly into the evaporator under pre-set conditions in the manner to be subsequently described.

Glycol unit 35 is illustrated in FIG. 1 with dashed line circuitry for clarity and ease of understanding. Glycol unit 35 comprises a sealed tank 36 containing a small reserve of the glycol-water mixture coolant 38. In the embodiment illustrated, the volume of coolant 38 in the tank is less than one gallon. The bottom of the tank 36 communicates through line 40 with a pump 42. Output of the pump 42 is connected to a chiller coil 44 through line 46. The chiller coil 44 is coaxial of the refrigeration evaporator coil 26 and is of the counterflow type, as indicated by the flow arrows. In the embodiment illustrated, the chiller coil 44 comprises a ½ inch copper tube inside a ⅞ inch copper evaporator tube.

Figure 2:
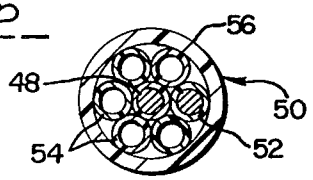
FIG. 2 is a cross-sectional view of a beer line run showing the relationship of the glycol coolant therein.

The chiller coil 44 communicates directly through line 48 with the beer line run 50. Coolant line 48 extends to the farthest point of the line run 50 where the coolant is then returned to the tank 36 through return line 52. The line run 50 may be of conventional form, as illustrated in FIG. 2 of the drawings. Thus, line run 50 comprises a plurality of beer tubes 54 surrounding and in contact with the coolant line 48, said tubes and line being tightly wrapped, together with coolant return line 52 with surrounding insulation 56.

In operation, the expansion valve 30 is pre-set to open when the vapor pressure in the evaporator 26 drops to the point where the desired temperature of the glycol coolant in the chiller coil 44 is obtained. When that condition occurs, the valve 30 opens and meters hot refrigerant gas from the discharge side of the compressor 16 directly into the evaporator 26. The hot gas causes just enough liquid refrigerant to boil and thereby maintain the pre-set pressure in the evaporator. Maintenance of a constant pressure in the evaporator results in a constant temperature for the glycol coolant in the chiller coil 44.

The improved results achieved with the cooling system 10 may best be appreciated with reference to the following example. A system 10 employing a pump 42 operating at a flow rate of 100 gallons per hour was connected with a line run 400 feet in length. Beer temperature in the storage area was 34° F. and the pre-set coolant temperature was 30° F. At station #1, 50 feet away, the dispensed beer temperature was 34.5° F., and the temperature of the coolant was 30.5° F. At station #2, 200 feet away, the temperature of the dispensed beer was 36° F., and the temperature of the coolant was 32° F. At the last station #3, 400 feet away, the temperature of the beer was 38° F., and the temperature of the coolant was 34° . It will thus be seen that the beer at all stations was within the desired range of 34°–38° F. Circulation time for the complete circuit of the glycol coolant was 2 minutes and 50 seconds and the "load" on the continuously operating compressor was proportional to a temperature rise of 4° F. in the glycol coolant.

The continuously running compressor reacts to the heating load as it comes into the refrigeration unit 15 and thus is able to operate beneath rated capacity. With the temperature regulation system of the invention, there is eliminated the need for large storage of glycol refrigeration capacity found in prior such cooling systems. Thus, the invention requires only sufficient coolant to fill the lines and prime the pump 42, this amount in the example described being 5.5 gallons, with about 4.9 gallons thereof in the line run.

It will be appreciated from the foregoing detailed description of the invention and the illustrative embodiment thereof that numerous variations and modifications may be effected without departing from the true spirit and scope of the novel concepts of the principles of the invention.

What is claimed is:

1. A cooling system for beverages delivered through a line run to a dispensing station remote from a beverage storage area comprising:

a refrigeration unit controllable without thermostat comprising a fluid refrigerant circuit having a compressor, a condenser, and an evaporator coil:

a coolant unit comprising a coolant circuit having a coolant tank, a pump, a chiller coil in intimate contact with the evaporator coil of the refrigeration unit, and a coolant line and coolant return line in the line run; and means for maintaining a substantially constant vapor pressure of the refrigerant in the evaporator coil so that the coolant in the chiller coil is chilled to a substantially constant temperature.

2. A cooling system according to claim 1 wherein said means comprises a bypass line and adjustable valve means connected between the output of said compressor and said evaporator coil for passing hot refrigerant gas directly to said evaporator coil when the vapor pressure in the evaporator coil falls below a pre-set pressure.

3. A cooling system according to claim 2 wherein said valve means comprises an expansion valve in said bypass line operational to automatically meter hot gas therethrough into the evaporator coil when the vapor pressure in the evaporator coil falls below the pre-set pressure.

4. A cooling system according to claim 1 comprising a thermal expansion valve serially in the refrigeration circuit between the condenser and evaporator coil and operational to maintain the evaporator coil flooded with liquid refrigerant.

5. A cooling system according to claim 1 wherein the compressor runs continuously during operation of the system and is responsive to the chilling load of the coolant liquid in the chiller coil.

6. A cooling system according to claim 1 wherein said chiller coil is coaxial with said evaporator coil and the refrigerant and coolant flow countercurrently.

7. A cooling system according to claim 1 wherein the coolant comprises a glycol-water mixture and the volume of said tank is substantially less than the volume of the mixture in the coolant circuit outside of the tank.

8. A cooling system for beer delivered through a line run to a dispensing station remote from a beer cooler storage area comprising:

a closed refrigeration circuit controllable without thermostat containing a low boiling refrigerant comprising serially a compressor, a condenser coil, a thermal expansion valve, and an evaporator coil, said thermal expansion valve operational to maintain the evaporator coil flooded with liquid refrigerant;

a closed glycol-water coolant circuit comprising serially a coolant tank, a pump for pumping the coolant from the tank, a chiller coil coaxial with and of smaller diameter than said evaporator coil, and a coolant line and coolant return line in the line run; and means for maintaining a substantially constant pre-set vapor pressure of the refrigerant in the evaporator coil and a substantially constant temperature of the coolant in the chiller coil, said compressor running continuously during operation of the system.

9. The cooling system of claim 8 wherein said means comprises an externally regulated expansion valve and a bypass line connected between the evaporator coil and the output of the compressor, said expansion valve operable to automatically open and meter hot refrigerant gas directly into the evaporator coil to maintain the pre-set pressure in the evaporator coil.

10. The cooling system of claim 9 wherein the volume of the coolant in the tank is a relatively small fraction of the volume of the coolant in the remainder of the coolant circuit.

11. The cooling system of claim 10 wherein the operating rate of the compressor is responsive to the rise in temperature of the coolant returned to the tank through the coolant return line.

* * * * *